United States Patent [19]

Sircovich

[11] Patent Number: 4,619,099

[45] Date of Patent: Oct. 28, 1986

[54] METHOD OF ERECTING ARCHED STRUCTURES

[76] Inventor: Oscar Sircovich, 5 Cremieux St., Jerusalem, Israel

[21] Appl. No.: 641,600

[22] Filed: Aug. 17, 1984

[30] Foreign Application Priority Data

Aug. 19, 1983 [IL] Israel ..... 69530

[51] Int. Cl.[4] ..... E04B 1/32; E04B 1/35; E04H 12/18

[52] U.S. Cl. ..... 52/745; 52/86; 52/640; 52/646

[58] Field of Search ..... 52/80, 82, 83, 85, 86, 52/640, 641, 645, 741, 745, 646; 135/905

[56] References Cited

U.S. PATENT DOCUMENTS

| | | | |
|---|---|---|---|
| 3,057,119 | 10/1962 | Kessler | 52/86 X |
| 3,401,492 | 9/1968 | MacDonald | 52/86 |
| 3,530,622 | 9/1970 | Cohen | 52/86 |
| 4,284,094 | 8/1981 | Behrend | 52/86 X |

FOREIGN PATENT DOCUMENTS

| | | |
|---|---|---|
| 259664 | 5/1913 | Fed. Rep. of Germany . |
| 2249558 | 5/1975 | France . |
| 34092 | 3/1970 | Israel . |
| 49914 | 6/1976 | Israel . |
| 58781 | 11/1979 | Israel . |
| 61142 | 9/1980 | Israel . |
| 378519 | 7/1964 | Switzerland . |

*Primary Examiner*—Stuart S. Levy
*Assistant Examiner*—Lynn M. Sohacki
*Attorney, Agent, or Firm*—Ostrolenk, Faber, Gerb & Soffen

[57] ABSTRACT

The invention relates to a method for the on-site erection of large arched structures such as airplane hangars, fairs overhead coverings and the like. A plurality of truss or the like structural members each having two free, aligned ends and an intermediate, raised, apex-like section, are lined-up on a flat surface. Adjacent ends of the members are pivotally connected to each other. Adjacent pairs of the apexes are tyed to each other by a number of steel wires, of progressively increasing lengths. The first in-line and the last-in-line members are forcibly pushed one against the other, to close the distance therebetween, and achieve the formation of the arched structure. During this operation, the shorter wires undergo an elastic and then a plastic elongation, except for the longest wires, which remain elastically taut and together serve to support the arched structure.

8 Claims, 3 Drawing Figures

METHOD OF ERECTING ARCHED STRUCTURES

BACKGROUND OF THE INVENTION

The present invention relates to a method of erecting arched structures, particularly of relatively large spans as used, e.g., for the storing of agricultural products, for airplane hangars, and the like. The invention is particularly useful where the structure is to be used only for a limited time and then dismounted and rebuilt at another site, as in the case of international fairs.

Conventional methods of building arched structures indispensably require the use of scaffolding or other auxiliary means, to support the yet-to-be assembled members composing the arched structure. Such procedure is of course costly in terms of material, workmanship and time.

BRIEF SUMMERY OF THE INVENTION

It is therefore the major object of the present invention to provide a method for the above specified purpose that will overcome the disadvantages of the known constructing methods.

It is a further object of the invention to provide a method by which the arched structure will be substantially self-erecting.

According to a general aspect of the invention, there is provided a method of erecting arched structures consisting of a plurality of rigid structural members, comprising the steps of lining-up on a flat surface a series of said structural members, each member having two free ends and an apex at a point located above a line drawn therebetween, pivotally connecting to each other adjacent ends of the members, loosely tying to each other adjacet pairs of said apexes by a number of strings of progressively increasing lengths, made of an elastically deformable material, and erecting the structure into an arched form by forcibly closing the distance between the first- and the last-in-line members.

In practice a plurality of such members are employed and the said erection operation is maintained until the longest of each of the said strings associated with each pair of the members become elastically taut.

The strings are preferably made of steel, said lengths being selected in correlation with the Yield Point of the steel, and the said longest string will be of a higher strength than the other strings, and, in fact, designed in the same manner as applied to tension elements employed for holding together arched structures of the conventional type, namely satisfying the static and dynamic stresses applicable to the costruction as a whole.

BRIEF DESCRIPTION OF THE DRAWINGS

These and further constructional details and advantages of the present invention will become more clearly understood in the light of the ensuing description of a preferred embodiment of the invention, given by way of example only, with reference to the accompanying drawings wherein.

DESCRIPTION OF A PREFERRED EMBODIMENT

Figure 1:
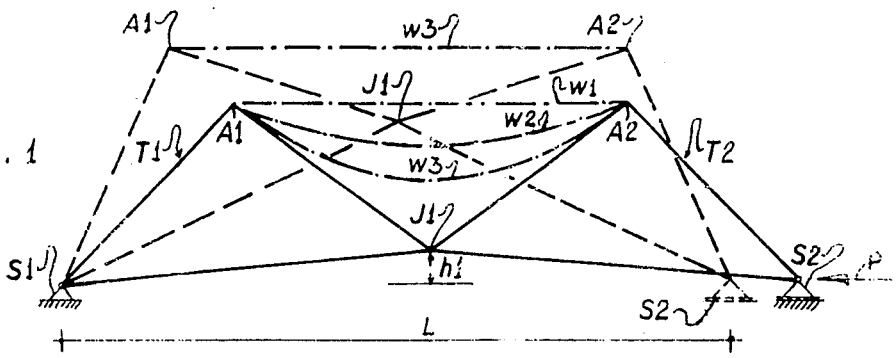
FIG. 1 is a schematic representation of a pair of structural members arranged according to the principles of the present invention, namely before applying the erecting force.

With reference to FIG. 1, there are shown, for sake of clarity, only two structural members in the form of trusses generally denoted T1 and T2. The truss T1 is hingedly supported by a fixed support S1, whereas the truss T2 is hingedly supported by a sliding support S2. The trusses are pivotably connected to each other at joint J1. The joint J1 is maintained at a certain, higher level h1 than the supports S1 and S2, for a reason to be explained below.

Apexes A1 and A2 of the trusses T1 and T2 are connected to each other by three (in this example) strings or wires W1, W2, and W3. As noted from the drawing, the string W1 is substantially taut, whereas strings W2 and W3 are of greater lengths and therefore hang loose by a progressively increasing amount.

Figure 2:
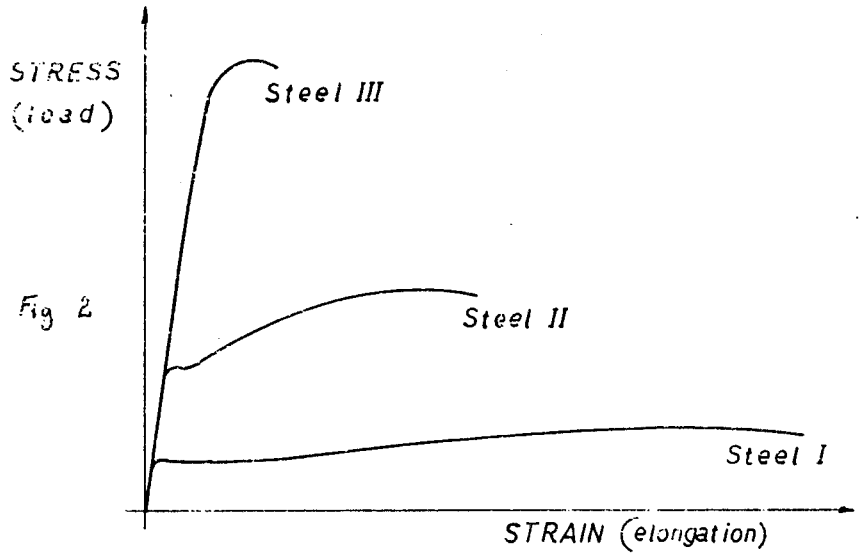
FIG. 2 is a typical Stress vs. Strain diagram of different kinds of steel.

Now, for better understanding the operational characteristics of the invention, it will be advisable to consult the diagram of FIG. 2. This is a typical Stress-Strain (or load versus elongation) representation of various kinds of steel. As is well-known in the art of the mechanical properties of metal, in accordance with Hookes' Law, at first the curves follow a linear portion in which the deformation is directly proportional to the applied load, where the ratio between them is defined as Young's Modulus or the Modulus of Elasticity. This linear portion represent the region of elastic deformation of the steel, which is then transformed (at the point called the Yield Point) into a slanting or curved portion representing the plastic deformation region where the metal looses its mechanical strength. In practice, using a sufficient safety coefficient, steels must be used well below their respective Yield Points.

Now, the concept of the present invenion is based on the *intentional overloading* of all except one of the strings W, while still at every given stage of erection, at least one of the wires will serve as a load-bearing element of the structure (actually only for supporting the self-weight of the structure), namely in a progressive, gradual manner depending on the number of strings employed.

Hence, referring back to FIG. 1, it will be seen that if a force P is applied to the sliding support S2, thus raising the Joint J1, the wire W1 is under tension or tensile force, while the other wires are in a slackened state. Further approach of the support S2 in the direction of the support S1 will cause additional elongation of the wire W1, which will eventually bring it above the elastic deformation region and beyond the Yield Point, into its plastic deformation state. The length of the string W2 is so calculated that it will become tensioned just before the point where the string W1 ceases to serve as a load bearing element of structure, namely beyond its yield region. Further erection of the structure will eventually cause the complete tearing of the wire W1, while string W2 is about to undergo the same routine of deformation.

It will be thus readily comprehended that by proper design calculations, taking into account the characteristics of the steel of which the strings are made, the number thereof, and the amount by which one string exceeds the length of the other, this erection routine can be continued until the final span of the structure, as denoted by L in FIG. 1, is reached whereby the string W3 ultimately assumes its structural function, namely, to hold the structure in its arcuate configuration as shown by broken lines in FIG. 1.

It will be advisable therefore to make this string W3 of an appropriate quality (say, grade III of FIG. 2) and to satisfy other specifications normally followed for ths purpose, including the proper safety coefficient of the material and other static and dynamic structural considerations.

Figure 3:
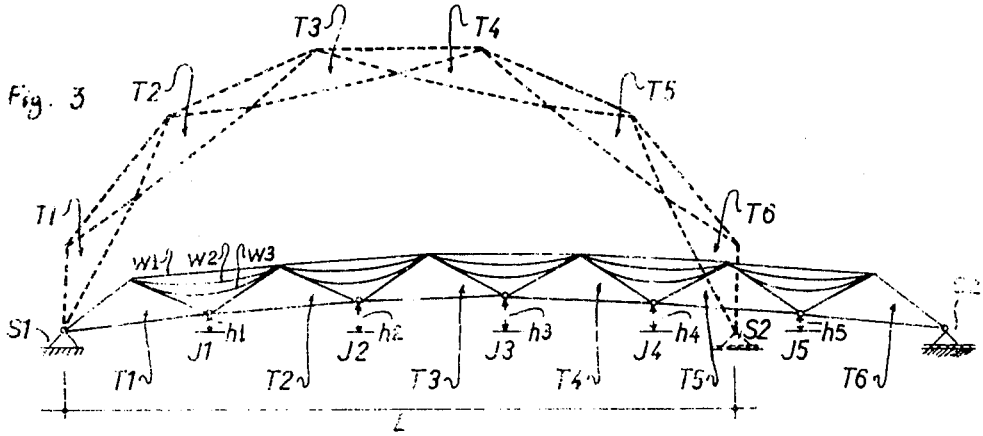
FIG. 3 illustrates a complete arched structure erected according to the method of the present invention.

FIG. 3 illustrates the operation of the method according to the invention with a larger number of trusses T1, T2, T3, . . . , T6 and wires W1, W2 and W3, in an analogous manner, which need not be further explained.

It has been thus established that the present invention provides a most efficient way for building arched structures with practically no additional equipment or auxiliary structures as known in connection with conventional methods.

Furthermore, the dismounting of the structure is also extremely efficient; all that is needed is to release one of the supports, say the sliding support S2, from its final, fixed position (shown in broken lines in FIGS. 1 and 3), and allow it to slide back towards its initial position, resulting in the gradual flattening of the arch.

Those skilled in the art will readily appreciate that many variations and modifications may be applied to the conceptual approach of the invention and to the manner it is to be put into practice. Thus, for example, other forms of structural elements—besides the truss form—or materials other than steel, may be used, such alterations should be deemed to fall within the scope of the invention as defined in and by the appended claims.

What is claimed is:

1. A method of erecting arched structures consisting of a plurality of rigid structured members, comprising the steps of:

(a) lining up on a flat surface in an upright position a series of structural members, each member forming a generally triangular truss having a base with two free ends and an apex at a point located above the base;

(b) pivotally connecting to each other adjacent ends of the members to form a continuous, interconnected row of members on the surface;

(c) tying to each other adjacent apexes by a plurality of cables of progressively increasing lengths, made of an elastically deformable material;

(d) hingedly supporting the free end of the first-in-line member;

(e) hingedly as-well-as slideably supporting the free end of the last-in-line member to enable sliding movement thereof along the surface in the direction of the hinge support;

(f) applying a force against the sliding support to cause its sliding movement while the row of members becomes erected into an arched form above the surface, and the shortest of each of the number of cables become taut; and (g) maintaining the erected form of the row of members until the longest of each of the number of cables becomes elastically taut while the shorter cables become plastically deformed.

2. The method as claimed in claim 1, wherein the erected form of the row of members is maintained until the longest of each of the said cables becomes tensioned and taut.

3. The method as claimed in claim 2, wherein the cables are made of steel, the length thereof being successively related to the Yield Point of the steel forming the cable.

4. The method as claimed in claim 3, wherein the longest of said cables is of a higher strength than the other cables to bear such stresses as may act on the structure.

5. The method as claimed in claim 2, comprising the further steps of:

(a) Hingedly supporting the free end of the first-in-line member; and (b) hingedly as-well-as slidingly supporting the free end of the last-in-line member, whereby the said erected row of members is achieved by a force applied to the sliding support in the direction of the other support.

6. The method as claimed in claim 5, comprising the further step of initially arranging the structural elements supported on the flat surface into an arcuate configuration.

7. The method as claimed in claim 1, wherein the structural members are truss elements.

8. The method as in claim 7, comprising a further step of supporting all pivotal connections of the members with respect to the surface on a series of raised supports so that the structure is initially shaped into a flat arc.

* * * * *